US010731319B2

(12) United States Patent
Bull et al.

(10) Patent No.: US 10,731,319 B2
(45) Date of Patent: Aug. 4, 2020

(54) AUGER CONNECTION MECHANISM

(71) Applicant: Tadano Mantis Corporation, Franklin, TN (US)

(72) Inventors: Reagan Bull, Franklin, TN (US); Thomas Wallace, Franklin, TN (US); Daniel Denney, Franklin, TN (US); Mark McKinley, Franklin, TN (US); Kei Ohara, Franklin, TN (US); Julie Fuller, Franklin, TN (US)

(73) Assignee: Tadano Mantis Corporation, Franklin, TN (US)

( * ) Notice: Subject to any disclaimer, the term of this patent is extended or adjusted under 35 U.S.C. 154(b) by 207 days.

(21) Appl. No.: 15/910,509

(22) Filed: Mar. 2, 2018

(65) Prior Publication Data

US 2018/0251952 A1 Sep. 6, 2018

Related U.S. Application Data

(60) Provisional application No. 62/466,951, filed on Mar. 3, 2017.

(51) Int. Cl.

| | |
|---|---|
| ***E02F 3/96*** | (2006.01) |
| ***E21B 7/00*** | (2006.01) |
| ***E02F 3/06*** | (2006.01) |
| ***E21B 15/00*** | (2006.01) |

(52) U.S. Cl.

CPC ..... *E02F 3/96* (2013.01); *E02F 3/06* (2013.01); *E21B 7/005* (2013.01); *E21B 15/00* (2013.01)

(58) Field of Classification Search

CPC ..... E21B 7/005; E21B 7/023; E21B 15/00; E02F 3/96; E02F 3/3604; E02F 3/3609; E02F 3/369; E02F 3/3677

See application file for complete search history.

(56) References Cited

U.S. PATENT DOCUMENTS 3,116,840 A 1/1964 Carbert et al.
3,207,044 A 9/1965 Hall

FOREIGN PATENT DOCUMENTS

FR 2414615 A1 8/1979

OTHER PUBLICATIONS

Extended European Search report for related EP App No. 18160056.0 dated Jul. 10, 2018, 8 pgs.

*Primary Examiner* — D. Andrews
(74) *Attorney, Agent, or Firm* — Procopio, Cory, Hargreaves & Savitch LLP

(57) ABSTRACT

An auger attachment system for an extendable boom having a first stage, and a second stage, the auger attachment system having a fixed mounting configured to couple to an auger, the fixed mounting being coupled to the second stage of the extendable boom, an extendable mounting, configured to couple to the auger, the extendable mounting being coupled to the first stage of the extendable boom, and a linear actuator configured to extend and retract the extendable mounting to transfer the auger from the extendable mounting to the fixed mounting.

20 Claims, 9 Drawing Sheets

AUGER CONNECTION MECHANISM

BACKGROUND

Field

The present disclosure generally pertains to an auger attachment system, and is more particularly directed to an auger attachment system for an extendable boom machine.

Related Art

Augers mounted on boom equipment or machines may be used in a variety of construction, mining, and other industrial applications. In some related art boom mounted auger systems, the auger may be mounted on the butt or stationary stage of the boom to allow the boom to be extended or retracted for picking or lifting operations without removing the auger. However, in this position, the entire machine would need to be moved laterally as the auger drills downward to maintain the auger in a vertical or plumb position due to the fixed length of the butt stage. In other related art boom mounted auger systems, the auger may be mounted on the second or moving stage of boom. However, in this position, the second stage could not be used for any lifting or picking operations until the auger is removed, which could be a complex process due to the weight of the auger and torque generated during operation of the auger.

SUMMARY

Aspects of the present application may relate to an auger attachment system for an extendable boom having a first stage, and a second stage. The auger attachment system may include a fixed mounting configured to couple to an auger, the fixed mounting being coupled to the second stage of the extendable boom; an extendable mounting, configured to couple to the auger, the extendable mounting being coupled to the first stage of the extendable boom, and a linear actuator configured to extend and retract the extendable mounting to transfer the auger from the extendable mounting to the fixed mounting.

Additional aspects of the present application may relate to include an auger system for an extendable boom having a first stage, and a second stage. The auger system may include a hydraulic auger and an auger attachment system. The auger attachment system may include a fixed mounting configured to couple to the auger, the fixed mounting being coupled to the second stage of the extendable boom, an extendable mounting, configured to couple to the auger, the extendable mounting being coupled to the first stage of the extendable boom, and a linear actuator configured to extend and retract the extendable mounting to transfer the auger from the extendable mounting to the fixed mounting.

Further aspects of the present application may relate to a boom machine including an extendable boom, a hydraulic auger, and an attachment system. The extendable boom may include a first stage and a second stage. The auger attachment system includes a fixed mounting configured to couple to the auger, the fixed mounting being coupled to the second stage of the extendable boom; an extendable mounting, configured to couple to the auger, the extendable mounting being coupled to the first stage of the extendable boom, and a linear actuator configured to extend and retract the extendable mounting to transfer the auger from the extendable mounting to the fixed mounting.

DETAILED DESCRIPTION

Figure 1:
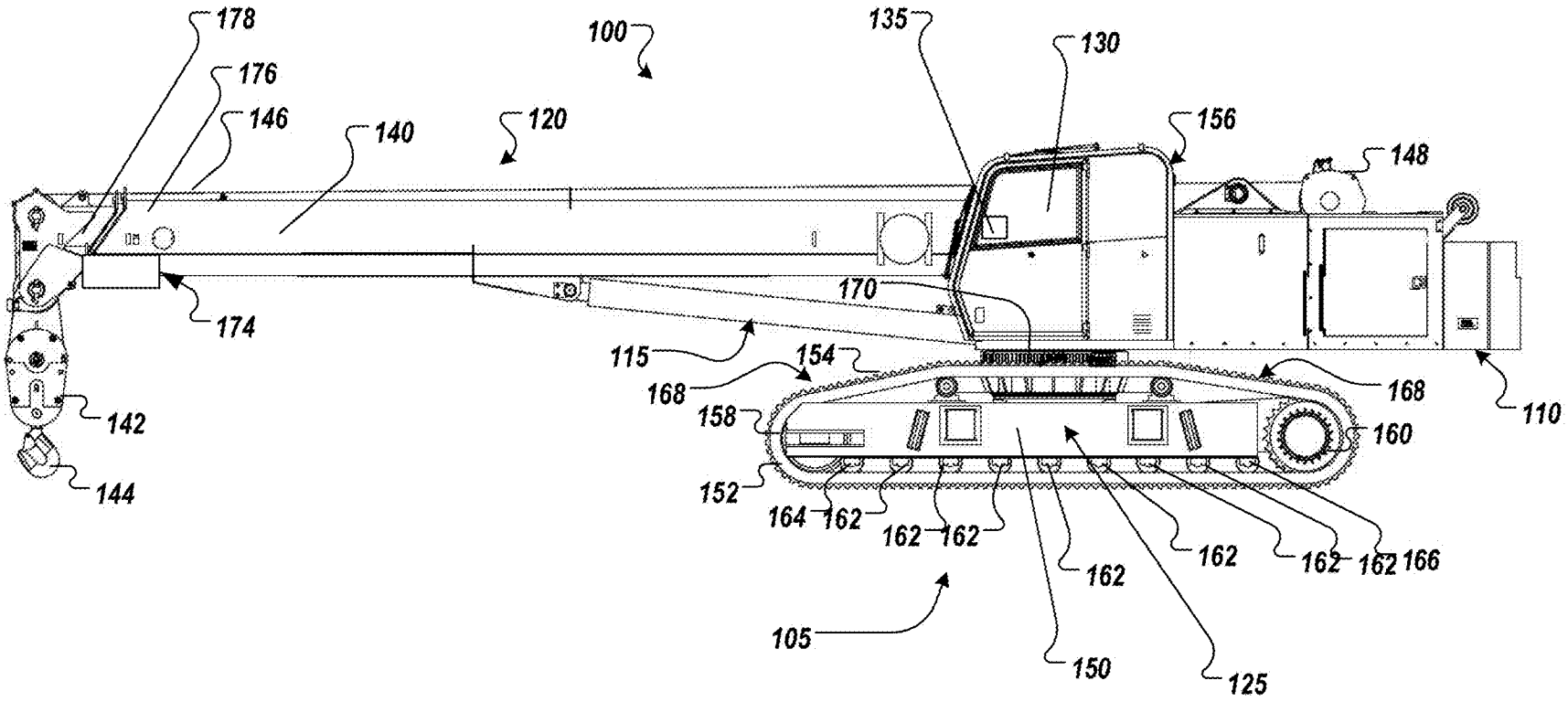
FIG. 1 is a side elevation view of a boom machine including an auger attachment system according to example implementations of the present application.

The following detailed description provides further details of the figures and example implementations of the present application. Reference numerals and descriptions of redundant elements between figures are omitted for clarity. Terms used throughout the description are provided as examples and are not intended to be limiting. For example, the use of the term "automatic" may involve fully automatic or semi-automatic implementations involving user or operator control over certain aspects of the implementation, depending on the desired implementation of one of ordinary skill in the art practicing implementations of the present application.

In some example implementations, an auger attachment system that allows attachment of the auger to either the butt stage or second stage of a boom machine, and transition therebetween may be provided. For example, the auger attachment system may provide a fixed mounting on the second stage boom and an extendable mounting on the butt stage of the boom, both mountings being configured to hold the auger. Further, in some example implementations, the auger attachment system may also include an actuator configured to extend and retract the extendable mounting to transfer to auger from the extendable mounting to the fixed mounting.

FIG. 1 is a side elevation view of an embodiment of a boom machine 100 including an undercarriage track system 105. The term "machine" may refer to any machine that that performs some type of operation associated with an industry such as mining or construction, or any other industry known in the art, such as a hydraulic mining shovel, lifting crane, an excavator, a track-type tractor (bulldozer), a cable shovel, a dragline, or the like. In the embodiment illustrated, the boom machine 100 is a track-type boom crane.

The boom machine 100 may include a machine body 110, one or more hydraulic systems 115, one or more engaging implements 120, and an undercarriage structure 125. The machine body 110 may optionally include a cab 130 to house a machine operator. An electronic control system 135 can be housed in the cab 130 that can be adapted to allow a machine operator to manipulate and articulate the engaging implements 120 for any suitable application and provide performance readouts to the operator. As discussed below, the electronic control system 135 may include a computing device such as computing device 805 of FIG. 8 discussed below.

Though a cab 130 to house an operator is illustrated on the machine body 110, example implementations of the present application are not required to have a cab or be directly operated by an operator on the boom machine 100. For example, some example implementations of the present application may be remotely operated by an operator not directly riding the boom machine 100. The remote operator may be in the same general area as the boom machine 100 or may be located a large distance away. In some embodiments, the electric control system 135 may allow control of the boom machine 100 via radio frequency communication, cellular communication, wired communication, or any other type of remote control that might be apparent to a person of ordinary skill in the art.

The hydraulic system 115 may connect at one end to the machine body 110 and may support the engaging implement 120 at an opposing, distal end. As illustrated, the engaging implement 120 may be a lifting boom 140 with a lift attaching system 142 having a lifting attachment implement 144 mounted on a tension line 146. The tension line 146 is around a winch system 148 mounted behind the cab 130. The lifting boom 140 may be an extendable boom having a butt or stationary stage 176 and a second or extendable stage 178. The extension and retract of the second stage 178 relative to the butt stage 176 may be performed hydraulically and controlled by the electronic control system 135. Example implementations are not limited to this configuration, and the extension/retraction of the second stage 178 may be controlled by any mechanism that may be apparent to a person of ordinary skill in the art.

Additionally, the engaging implement 120 may also include an auger attachment system 174 to allow attachment of an auger device to either the butt stage 176 or the second stage 178. The auger attachment system 174 is discussed in greater detail with respect to FIGS. 2-6 below.

The engaging implement 120 is not limited to a lifting boom 140 and may be any type of engaging implement 120 that might be apparent to a person of ordinary skill in the art include a bucket boom for lifting an operator, a backhoe implement, or any other implement that might be apparent to a person of ordinary skill in the art.

The undercarriage structure 125 may include a support structure 150 and the undercarriage track system 105. The support structure 150 may connect the undercarriage track system 105 to the machine body 110 and may support the undercarriage track system 105.

The undercarriage track system 105 may include a track roller frame assembly 152 and an associated track chain assembly 154 on each side of the undercarriage structure 125. It will be appreciated that only one track roller frame assembly 152 and only one track chain assembly 154 is visible in FIG. 1.

The boom machine 100 may also include a power source 156 mounted on the machine body 110 behind the cab 130 (in FIG. 1). The power source 156 may provide power to one or more of the hydraulic system 115, the engaging implement 120, the electronic control system 135, the undercarriage track system 105, the auger attachment system 174 or any other system that might be apparent to a person of ordinary skill in the art. The power source 156 may include an engine such as, for example, a diesel engine, a gasoline engine, a gaseous fuel-powered engine, or any other type of combustion engine known in the art. The power source 156 may alternatively embody a non-combustion source of power such as a fuel cell, a power storage device, or another power source that might be apparent to a person of ordinary skill in in the art. The power source 156 may produce a mechanical or electrical power output that may then be converted to hydraulic pneumatic power for moving the engaging implement 120.

Each track roller frame assembly 152 may include one or more idler wheels 158, a drive sprocket wheel 160, and track roller assemblies 162. In the embodiment illustrated, an idler wheel 158 is coupled to the support structure 150 at one end, and the drive sprocket wheel 160 is coupled to the support structure 150 at an opposite end. In other embodiments, a pair of idler wheels 158 may be coupled to the support structure 150 and the drive sprocket wheel 160 may be adjacent to one of the idler wheels 158.

The drive sprocket wheel 160 may be powered in forward and reverse directions by the power source 156 of the boom machine 100. In some embodiments, the drive sprocket wheel 160 may be coupled to the engine of the boom machine 100 by a final drive. The drive sprocket wheel 160 drives the track chain assembly 154 to move the boom machine 100.

Track roller assemblies 162 may be positioned between the ends of the support structure 150 and at least partially below the support structure 150. In the embodiment illustrated, the track roller assemblies 162 are positioned between the idler wheel 158 and the drive sprocket wheel 160. In other embodiments, the track roller assemblies 162 are positioned between a pair of idler wheels 158. The track roller assemblies 162 may include a front roller assembly 164 may be positioned adjacent the idler wheel 158 at the front end of the support structure 150 and a rear roller assembly 166 may be positioned adjacent the drive sprocket wheel 160 at the rear end of the support structure 150. Idler wheels 158 and track roller assemblies 162/164/166 may be configured to guide the track chain assembly 154 around the support structure 150.

In embodiments, each track chain assembly 154 may include track links (not numbered) inter-connected and linked together to form a closed chain. In the embodiment illustrated, track links are connected to, such as by fastening, ground engaging shoes 168. The ground engaging shoes 168 or ground engaging portions may be configured to overlap. In other embodiments, each track chain assembly 154 includes track pads inter-connected and linked together. The track pads may include a track link and a ground engaging shoe that are cast or forged as an integral unit.

As illustrated, the machine body 110 may be connected to the support structure 150 by a rotating mechanism 170. Further, the support structure 150 may connect two track roller frame assemblies 152 of the undercarriage track system 105 to form a support base for the machine body 110. In some example implementations, the rotating mechanism 170 may be a hydraulic rotary actuator that allows the machine body 110 to rotate relative to the undercarriage track system 105. However, the rotating mechanism 170 is not limited to this configuration and may be any mechanism that allows relative rotation between the support structure 150 and the machine body 110.

In FIG. 1, the boom machine 100 is illustrated as a tracked machine. However, example implementations are not limited to this configuration, and in other example implementations, the boom machine 100 may be a wheeled vehicle or any other type of machine having a boom 140 for lifting and/or placing operations that might be apparent to a person of ordinary skill in the art.

Figure 2A:
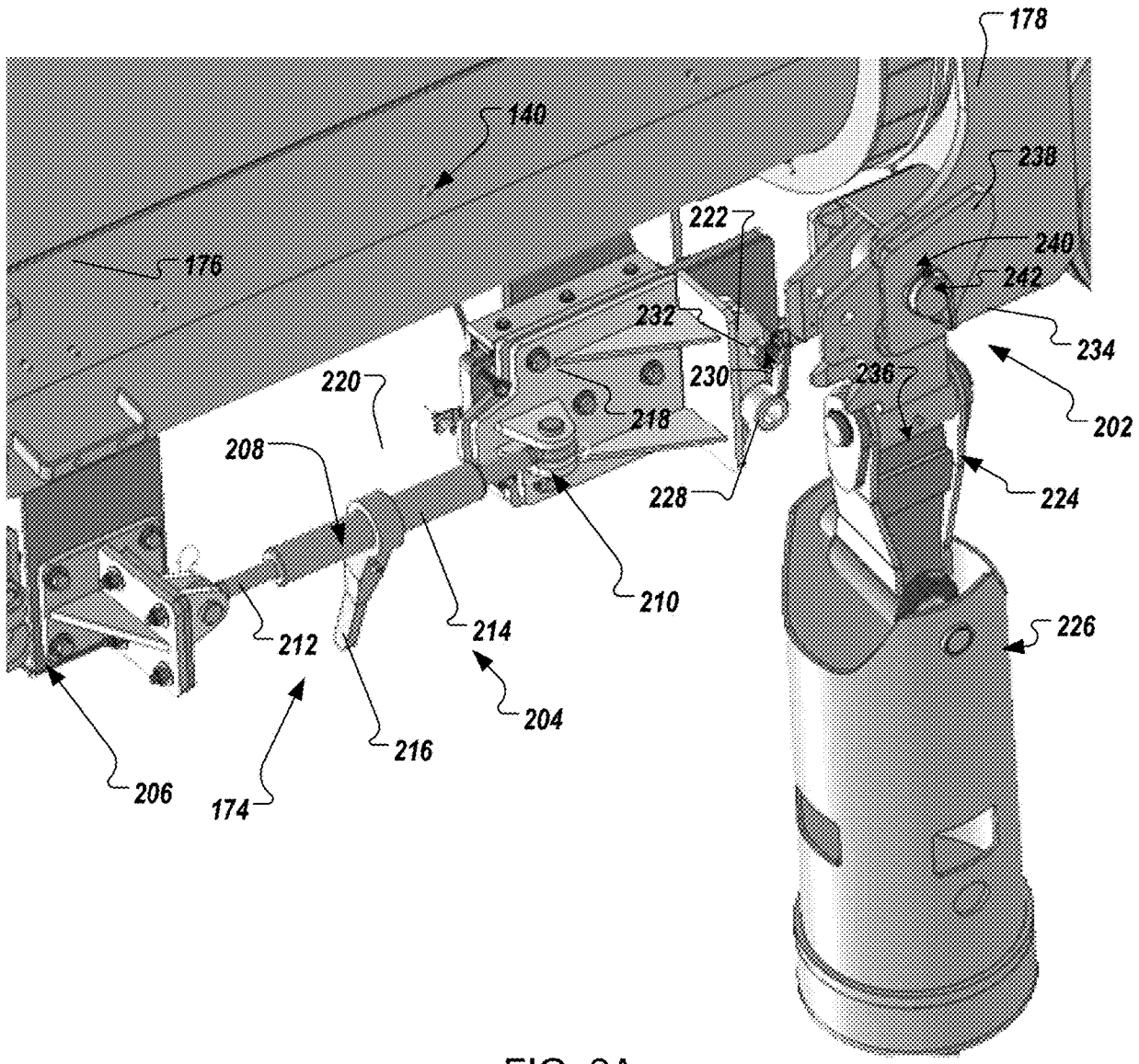
FIG. 2A is a perspective view of auger attachment system according to example implementations of the present application in a first configuration.
Figure 2B:
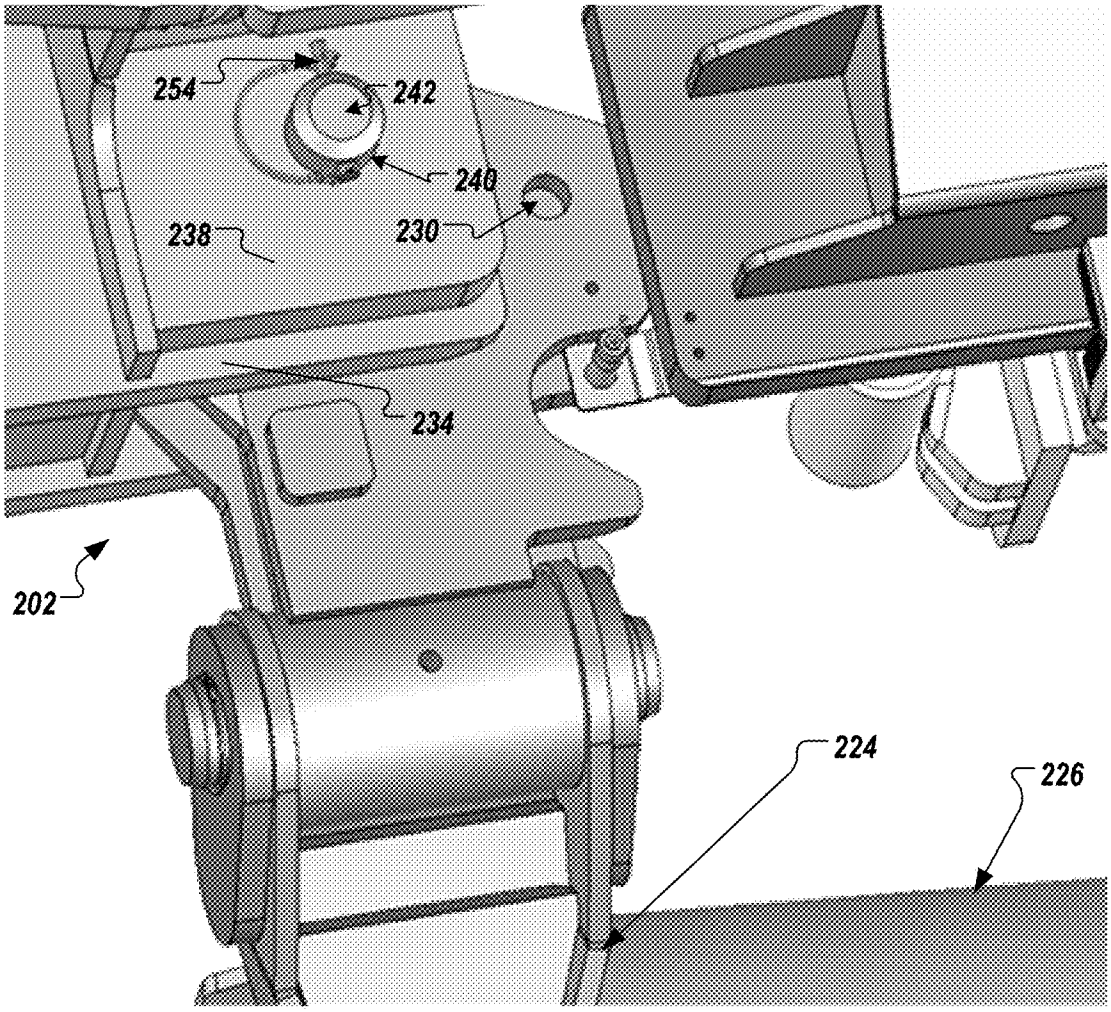
FIG. 2B is a perspective view of auger attachment system from a reverse angle of FIG. 2A.

FIG. 2A is a perspective view of auger attachment system 174 according to example implementations of the present application in a first configuration. FIG. 2B is a perspective view of auger attachment system 174 from a reverse angle of FIG. 2A. As illustrated, the auger attachment system 174 includes a fixed mounting 202 mounted on the second stage 178 and an extendable mounting 204 mounted on the butt stage 176 of the boom 140.

The extendable mounting 204 may include a fixed block 206, a linear actuator 208 and a sled 210. The fixed block 206 is attached to the butt stage 176 in a fixed manner to provide a stationary base for the linear actuator 208 to push against. The attachment mechanism between the butt stage 176 and the fixed block 206 is not particularly limited and may include welding, bolting, press fitting or any other connection mechanism that might be apparent to a person of ordinary skill in the art. Additionally, the fixed block 206 may also be formed as unitary piece of the butt stage 176 (e.g., an extension or protrusion formed as part of a housing of the butt stage 176).

The linear actuator 208 is illustrated as a mechanical actuator having a screw member 212 inserted into one end of a rotary housing 214 attached to the sled 210. The rotary housing 214 may have a handle 216 that may be configured to be used to rotate the rotary housing 214. By rotating the rotary housing 214 relative to the screw member 212, a linear force may be generated to move the sled 210 toward and away from the fixed mounting 202 mounted on the second stage 178.

Though the linear actuator 208 is illustrated as a mechanical actuator in FIGS. 2A and 2B, example implementations are not limited to this configuration. Other example implementations may include a hydraulic actuator, electric actuator, or any other type of linear actuator that may be apparent to a person of ordinary skill in the art.

The sled 210 includes a mounting body 218 slidingly attached to a sliding support member 220 attached to the butt stage 176. The attachment mechanism between the butt stage 176 and the sliding support member 220 is not particularly limited and may include welding, bolting, press fitting or any other connection mechanism that might be apparent to a person of ordinary skill in the art. Additionally, the sliding support member 220 may also be formed as unitary piece of the butt stage 176 (e.g., an extension or protrusion formed as part of a housing of the butt stage 176). The mounting body 218 may have a mounting bracket 222 at one end that is configured to engage an attaching bracket 224 connected to an auger 226. As illustrated, the mounting bracket 222 may have a protrusion 228 extending laterally outward. The mounting bracket 222 may also include a pin hole 230 that extends through the mounting bracket 222. In some example implementations, a retaining pin 232 may be removably inserted through the pin hole 230. Further, in some example implementations, a sensor may detect when the auger is present in the sled and a sensor to detect when the auger is fully retracted and contacting stoppers (e.g., in a stowage position).

The fixed mounting 202 may include an auger support arm 234 having an auger support groove 236 configured to support the attaching bracket 224 of the auger 226. As illustrated in FIGS. 2A and 2B, the fixed mounting 202 may also include a lateral support plate 238 mounted to both the front and back sides of the auger support arm 234. Each lateral support plate 238 may have an auger support hole 240 extending through the thickness of the lateral support plate 238. When the attaching bracket 224 of the auger is attached to the fixed mounting 202, a holding pin 242 may be inserted through the auger support hole 240 and through the attaching bracket 224 to hold the auger 226 in place. The engagement between the attaching bracket 224 and the fixed mounting 202 are discussed in greater detail below with respect to FIGS. 3 and 4.

In the first configuration of FIGS. 2A and 2B, the attaching bracket 224 of the auger 226 is connected to the fixed mounting 202. Additionally, the holding pin 242 is inserted through the auger support holes 240 of the lateral support plates 238 and the attaching bracket 224 of the auger 226. In some example implementations, a sensor may be provided to detect a position of the linear actuator. Further, FIGS. 2A and 2B illustrate the auger 226 fully deployed to the second or moving stage. While the actuator may be illustrated in a partially extended position in FIGS. 2A and 2B, in this position, the sled 210 is as far back as it can go, contacting stoppers. This position may be interpreted as the "stowed" position for the sensors and software.

Figure 3:
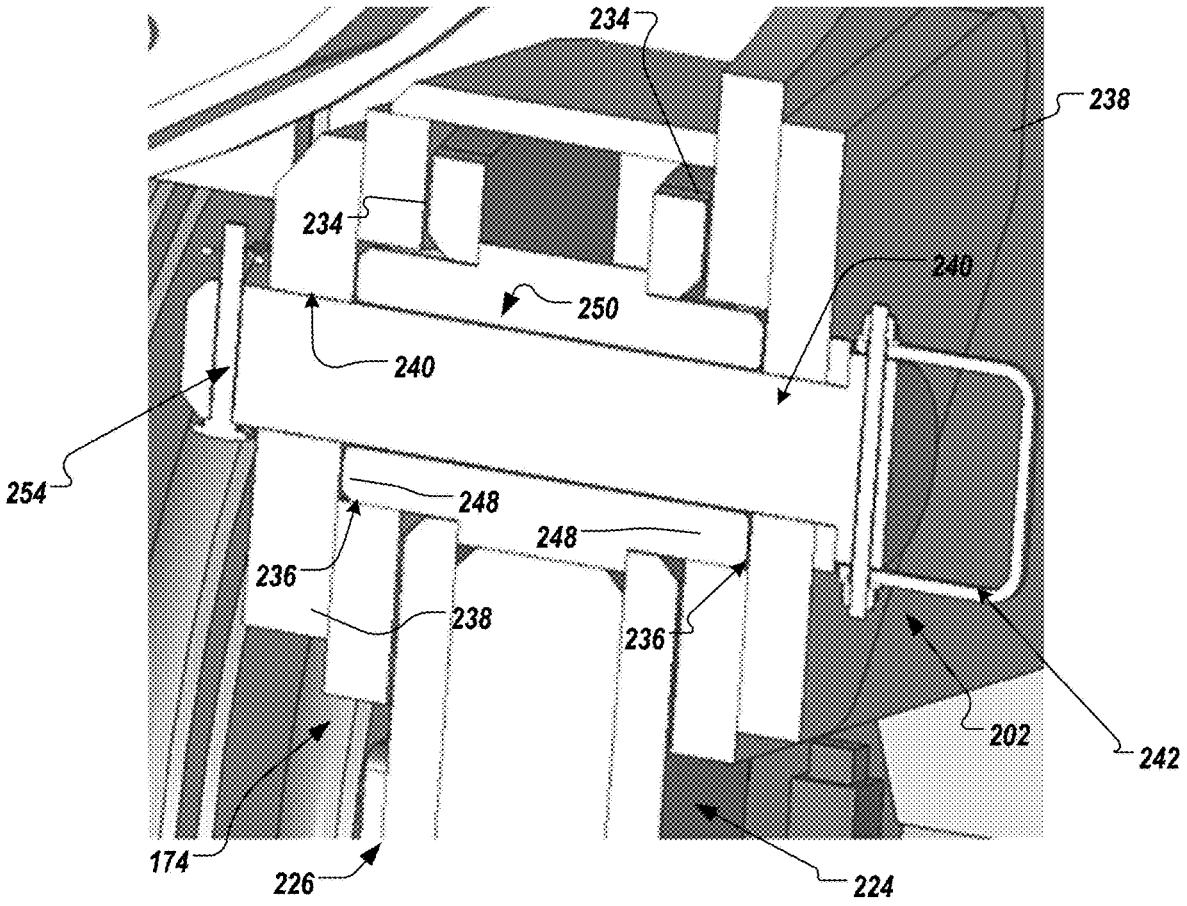
FIG. 3 is a section view of the auger attachment system according to example implementations of the present application in the first configuration.

FIG. 3 is a section view of the auger attachment system 174 according to example implementations of the present application in the first configuration. In FIG. 3, similar reference numerals are used for components discussed above and redundant discussion may be omitted. As illustrated in FIG. 3, when the auger 226 is installed on the fixed mounting 202, the support protrusion 248 of the attaching bracket 224 is inserted into the auger support groove 236 of the auger support arm 234. Further, the auger support holes 240 of the lateral support plates 238 are aligned with the support hole 250 extending through the attaching bracket 224 and the holding pin 242 is inserted through the support hole 250 and the auger support holes 240. Additionally, as illustrated in FIG. 3, a retaining clip 254 may be inserted through end of the holding pin 242 to hold the holding pin 242 in place. In some example implementations, the support protrusion 248 may rest in the auger support groove 236 such that auger support groove 236 holds the entire weight of the auger 226 such that the holding pin 242 can be inserted and removed without any required tools.

Figure 4:
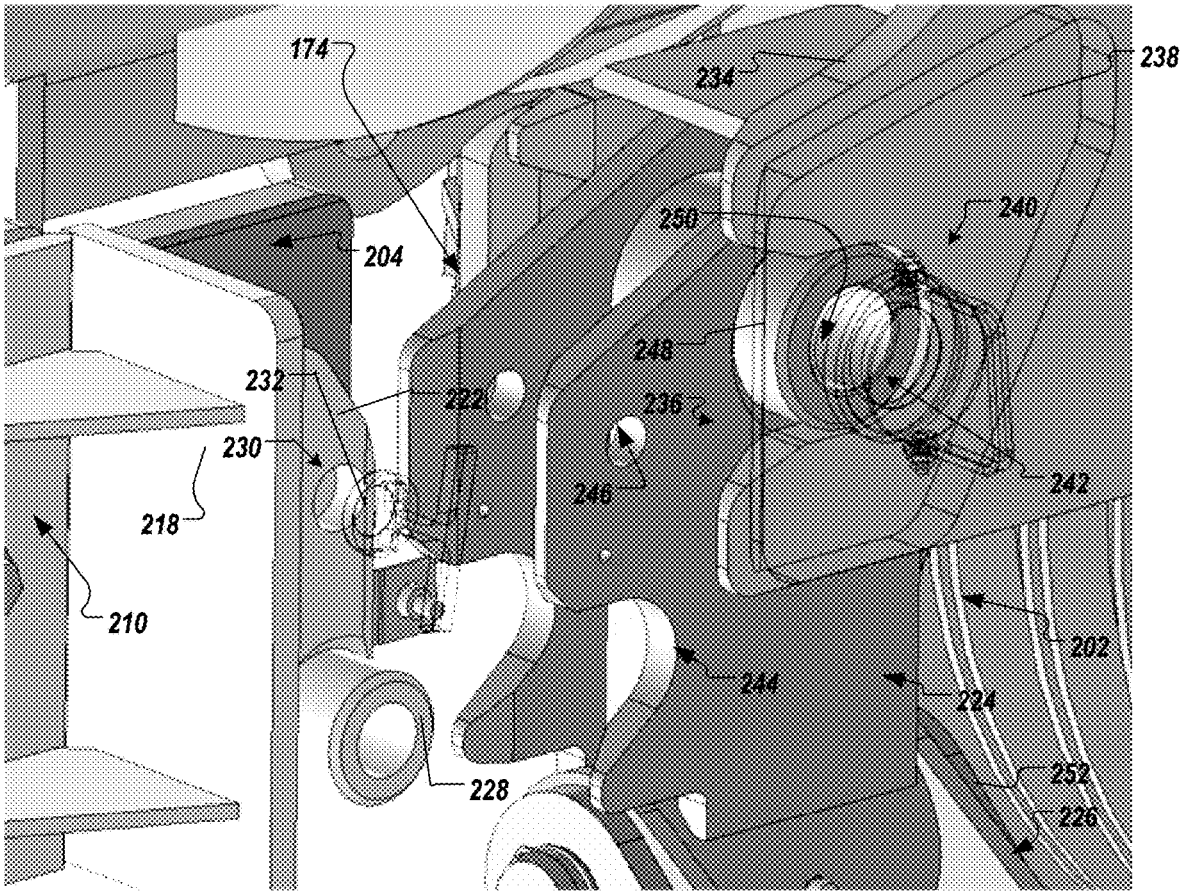
FIG. 4 is an enlarged view of the auger attachment system according to example implementations of the present application in the first configuration.

FIG. 4 is an enlarged view of the auger attachment system 174 according to example implementations of the present application. In FIG. 4, similar reference numerals are used for components discussed above and redundant discussion may be omitted. As illustrated in FIG. 4, the attaching bracket 224 of the auger 226 may include a groove 244 configured to receive the protrusion 228 of the mounting bracket 222 of the sled 210 when the auger 226 is mounted on the extendable mounting 204. Additionally, the attaching bracket 224 may also include a support pin hole 246 configured to receive the retaining pin 232 when the auger 226 is mounted on the extendable mounting 204.

Further, the attaching bracket 224 may also include a support protrusion 248 configured to be inserted into the auger support groove 236 when the auger 226 is mounted on the fixed mounting 204. In some example implementations, the auger support hole 240 with a support hole 250 formed through the support protrusion 248 of the attaching bracket 224 of the auger 226. The holding pin 242 may be inserted through the support hole 250 extending through the attaching bracket 224. Again, in some example implementations, the support protrusion 248 may rest in the auger support groove 236 such that auger support groove 236 holds the entire weight of the auger 226 such that the holding pin 242 can be inserted and removed without any required tools.

The attaching bracket 224 may also include a pivot 252 to allow lateral movement of the auger 226 to allow greater freedom of positioning the auger 226.

Figure 5:
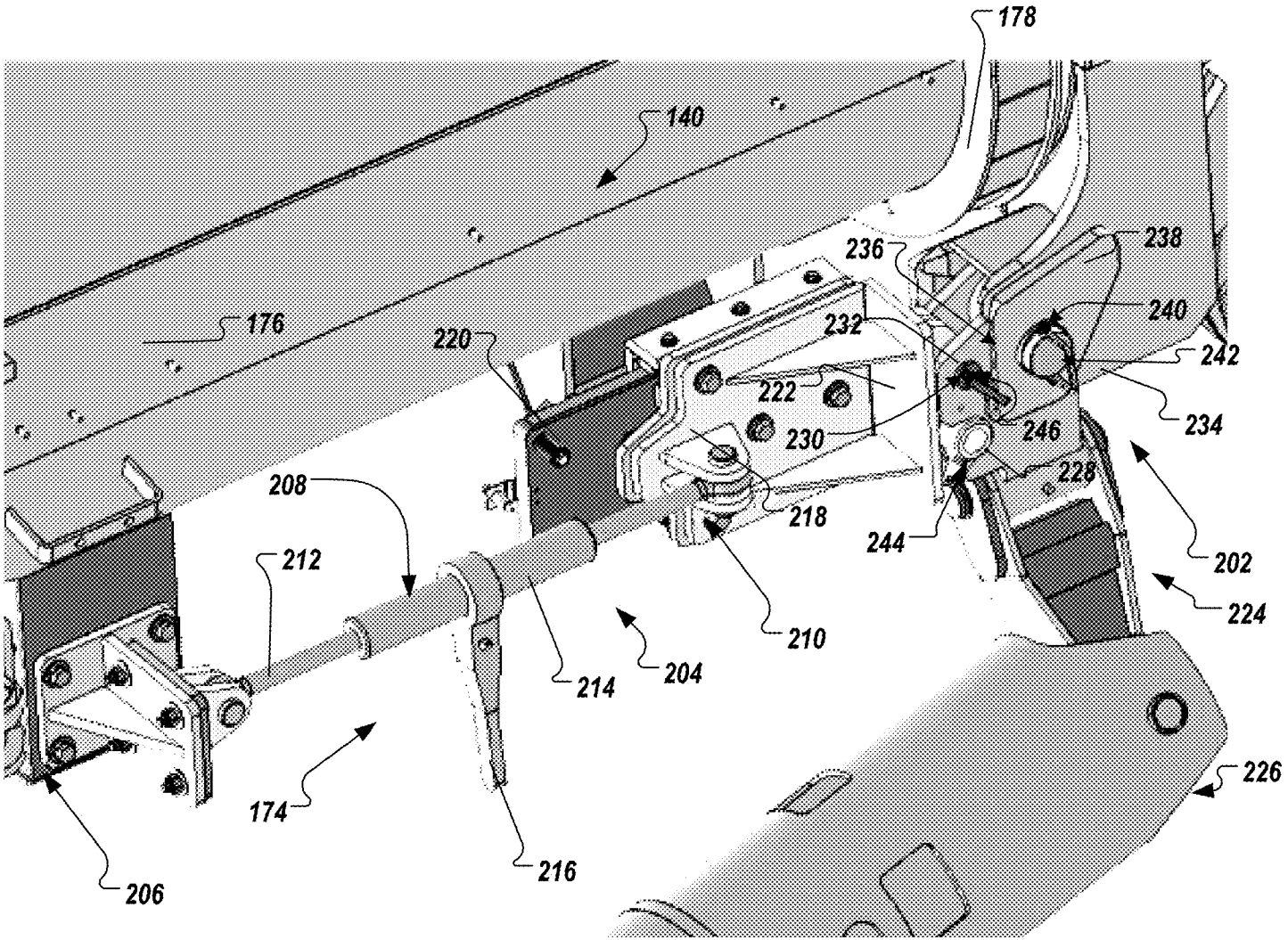
FIG. 5 is a perspective view of the auger attachment system according to example implementations of the present application in a second configuration.

FIG. 5 is a perspective view of the auger attachment system according to example implementations of the present application in a second configuration. In FIG. 5, similar reference numerals are used for components discussed above and redundant discussion may be omitted. In the second configuration of FIG. 5, the attaching bracket 224 of the auger 226 is connected to both the fixed mounting 202 and the sled 210 of the extendable mounting 204. Specifically, the linear actuator 208 has been actuated to fully extend the sled 210 toward the fixed mounting 202. Additionally, the protrusion 228 of the mounting bracket 222 has been inserted into the groove 244 of the attaching bracket 224 of the auger 226. Further, the retaining pin 232 has been inserted through the pin hole 230 of the mounting bracket 222 and the support pin hole 246 of the attaching bracket 224.

As discussed above, the holding pin 242 is still inserted through the auger support holes 240 of the lateral support plates 238 and the attaching bracket 224 of the auger 226. In this configuration, if the second stage 178 is moved relative to the butt stage 176 of the boom 140, serious damage could be done to the auger attachment system 174. In some example implementations, the attachment of the auger 226 to the extendable mounting 204, the position of the linear actuator, or the presents of the auger in the stowage position may be detected by sensors placed in various locations, and based on the sensor readings and other crane configuration information, the electronic control system 135 may lock-off extension of the boom 140 or the activation of the auger drive.

Figure 6:
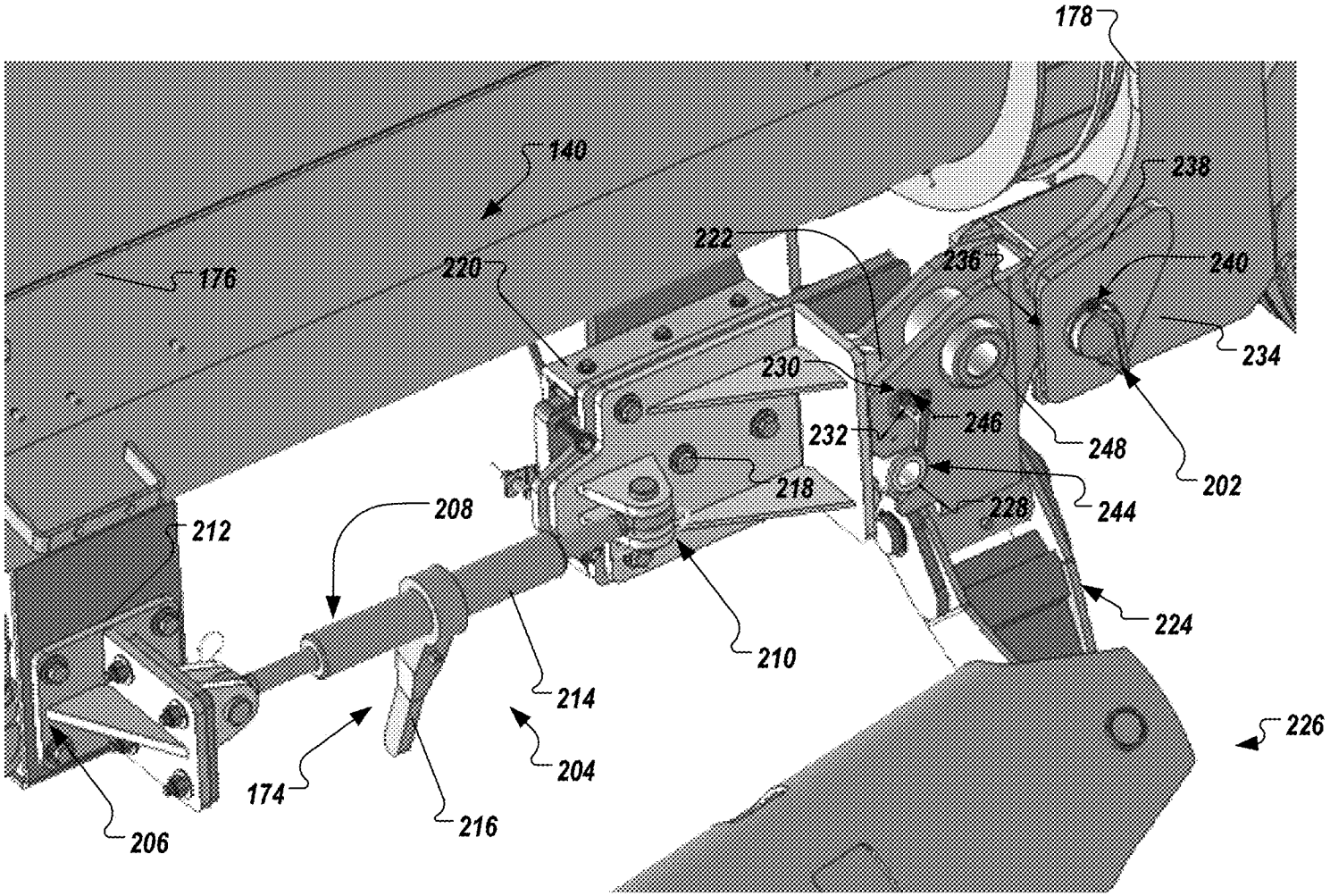
FIG. 6 is a perspective view of the auger attachment system according to example implementations of the present application in a third configuration.

FIG. 6 is a perspective view of the auger attachment system according to example implementations of the present application in a third configuration. In FIG. 6, similar reference numerals are used for components discussed above and redundant discussion may be omitted. In the third configuration of FIG. 6, the attaching bracket 224 of the auger 226 is connected to only the sled 210 of the extendable mounting 204. Specifically, holding pin 242 has been removed from auger support holes 240 and support plates 238 to allow auger 226 and bracket 224 to be removed via sliding bracket 222. Holding pin 242 may be reinserted in holes 240 and plates 238 for storage after removal of attaching bracket 224 of the auger 226 via the sliding bracket 222. Further, the retaining pin 232 may be inserted through the pin hole 230 of the mounting bracket 222 and the support pin hole 246 of the attaching bracket 224. Additionally, the protrusion 228 of the mounting bracket 222 may be inserted into the groove 244 of the attaching bracket 224 of the auger 226. Further, the linear actuator 208 may be retracted to pull the sled 210 and the auger 226 attached to the sled 210 are retracted to contact stoppers.

Figure 7:
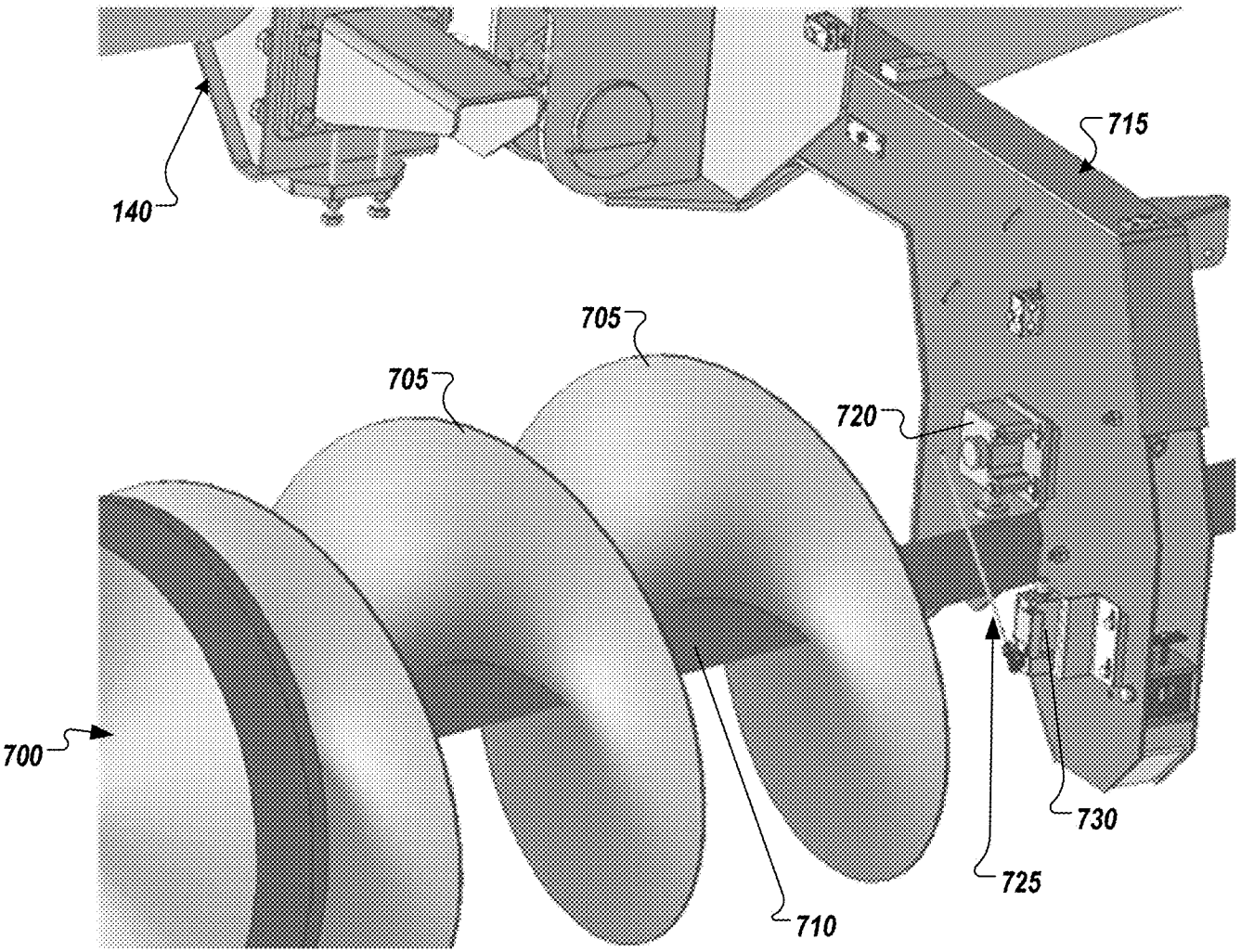
FIG. 7 illustrates a perspective view of an interlock that holds the auger attached by the auger attachment system according to example implementations of the present application.

FIG. 7 illustrates a perspective view of an interlock 715 that holds the auger 700 to be attached by the auger attachment system according to example implementations of the present application. As illustrated the auger 700 includes a plurality of blades 705 surrounding an auger shaft 710. The interlock 715 may be mounted on the lifting boom 140 and may include a groove 725 into which the auger shaft 710 may be inserted. The interlock 715 may also include sensors 720, 730 to control release of the auger or detect when the auger is in the groove 725 respectively. The sensor 720 may be used to control the release of the auger shaft 710 in response to an operation of the auger attachment system. Further, sensor 730 may be used to sense when the auger is in the groove 725 and works with software to prevent boom extension.

Figure 8:
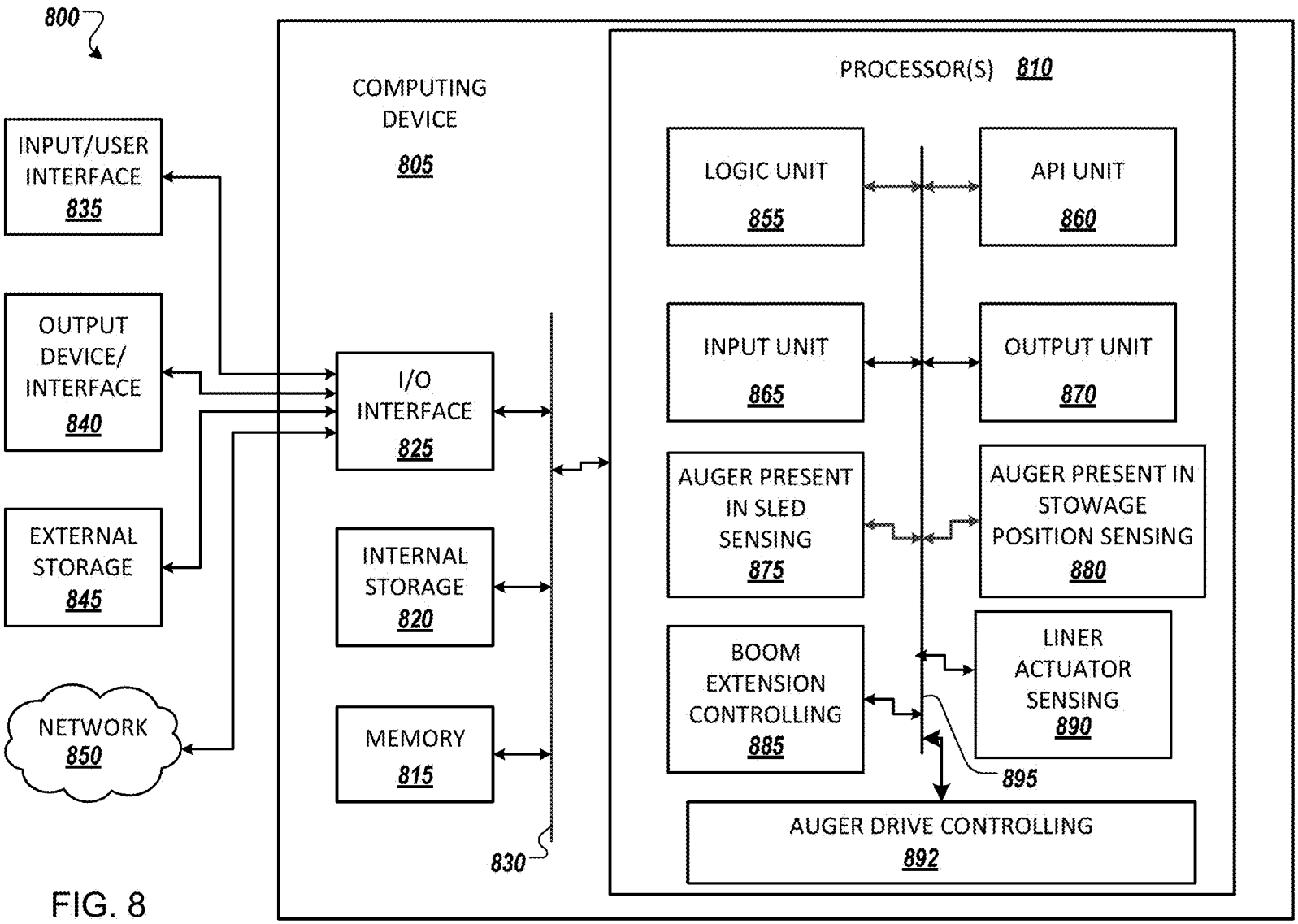
FIG. 8 illustrates an example computing environment for an electronic control system for a boom machine according to example implementations of the present application.

FIG. 8 illustrates an example computing environment 800 for an electronic control system for a boom machine, such as the electronic control system 135 of the boom machine 100 of FIG. 1. In some example implementations, the electronic control system may be a local control system allowing control by an operator located on the boom machine. In other example implementations, the electric control system may be a remote control system allowing control by a remote operator not directly located on the boom machine. In some example implementations, the remote operator may be in the same general area as the boom machine. In other example implementations, the remote operator may be located a large distance away from the boom machine. The electronic control system may allow control of the boom machine via radio frequency communication, cellular communication, wired communication, or any other type of remote control that might be apparent to a person of ordinary skill in the art.

The computing device 805 in the computing environment 800 can include one or more processing units, cores, or processors 810, memory 815 (e.g., RAM, ROM, and/or the like), internal storage 820 (e.g., magnetic, optical, solid state storage, and/or organic), and/or I/O interface 825, any of which can be coupled on a communication mechanism or bus 830 for communicating information or embedded in the computing device 805.

Computing device 805 can be communicatively coupled to input/user interface 835 and output device/interface 840. Either one or both of input/user interface 835 and output device/interface 840 can be a wired or wireless interface and can be detachable. Input/user interface 835 may include any device, component, sensor, or interface, physical or virtual, which can be used to provide input (e.g., buttons, touch-screen interface, keyboard, a pointing/cursor control, microphone, camera, braille, motion sensor, optical reader, and/or the like). Output device/interface 840 may include a display, television, monitor, printer, speaker, braille, or the like. In some example implementations, input/user interface 835 and output device/interface 840 can be embedded with or physically coupled to the computing device 805. In other example implementations, other computing devices may function as or provide the functions of input/user interface 835 and output device/interface 840 for a computing device 805.

Examples of computing device 805 may include, but are not limited to, highly mobile devices (e.g., smartphones, devices in vehicles and other machines, devices carried by humans and animals, and the like), mobile devices (e.g., tablets, notebooks, laptops, personal computers, portable televisions, radios, and the like), and devices not designed for mobility (e.g., desktop computers, server devices, other computers, information kiosks, televisions with one or more processors embedded therein and/or coupled thereto, radios, and the like).

Computing device 805 can be communicatively coupled (e.g., via I/O interface 825) to external storage 845 and network 850 for communicating with any number of networked components, devices, and systems, including one or more computing devices of the same or different configuration. Computing device 805 or any connected computing device can be functioning as, providing services of, or referred to as a server, client, thin server, general machine, special-purpose machine, or another label.

I/O interface 825 can include, but is not limited to, wired and/or wireless interfaces using any communication or I/O protocols or standards (e.g., Ethernet, 802.11x, Universal System Bus, WiMAX, modem, a cellular network protocol, and the like) for communicating information to and/or from at least all the connected components, devices, and network in computing environment 800. Network 850 can be any network or combination of networks (e.g., the Internet, local area network, wide area network, a telephonic network, a cellular network, satellite network, and the like).

Computing device 805 can use and/or communicate using computer-usable or computer-readable media, including transitory media and non-transitory media. Transitory media include transmission media (e.g., metal cables, fiber optics), signals, carrier waves, and the like. Non-transitory media include magnetic media (e.g., disks and tapes), optical media (e.g., CD ROM, digital video disks, Blu-ray disks), solid state media (e.g., RAM, ROM, flash memory, solid-state storage), and other non-volatile storage or memory.

Computing device 805 can be used to implement techniques, methods, applications, processes, or computer-executable instructions in some example computing environments. Computer-executable instructions can be retrieved from transitory media, and stored on and retrieved from non-transitory media. The executable instructions can originate from one or more of any programming, scripting, and machine languages (e.g., C, C++, C #, Java, Visual Basic, Python, Perl, JavaScript, and others).

Processor(s) 810 can execute under any operating system (OS) (not shown), in a native or virtual environment. One or more applications can be deployed that include logic unit 855, application programming interface (API) unit 860, input unit 865, output unit 870, auger present in sled sensing unit 875, auger present in stowage position sensing unit 880, boom extension controlling unit 885, linear actuator sensing unit 890, auger drive controlling unit 892 and inter-unit communication mechanism 895 for the different units to communicate with each other, with the OS, and with other applications (not shown). For example, auger present in sled sensing unit 875, auger present in stowage position sensing unit 880, boom extension controlling unit 885, linear actuator sensing unit 890, and auger drive controlling unit 892, may implement one or more processes to sense the position of the auger as well as control the extension of a boom, activation of the auger drive and detect extension of a linear actuator of an actuator attaching system. The described units and elements can be varied in design, function, configuration, or implementation and are not limited to the descriptions provided.

In some example implementations, when information or an execution instruction is received by API unit 860, it may be communicated to one or more other units (e.g., logic unit 855, input unit 865, output unit 870, auger present in sled sensing unit 875, auger present in stowage position sensing unit 880, boom extension controlling unit 885, linear actuator sensing unit 890, and auger drive controlling unit 892). For example, the auger present in sled sensing unit 875 may detect the presence of the auger in the sled. Similarly, the auger present in stowage position sensing unit 880 may detect the presence of the auger in the stowage position. Based on the detection of the auger position, the boom extension controlling unit 885 may lock or block extension of a boom (e.g., prevent the relative movement of a second stage relative to butt stage of a boom) or the auger controlling unit 892 may block activation of the auger drive. Additionally, the linear actuator sensing unit 890 may detect the extension of placement of an auger attachment system and based on the detected placement control the boom extension controlling unit 885 or auger drive controlling unit 892.

In some instances, the logic unit 855 may be configured to control the information flow among the units and direct the services provided by API unit 860, input unit 865, output unit 870, auger present in sled sensing unit 875, auger present in stowage position sensing unit 880, boom extension controlling unit 885, linear actuator sensing unit 890, and auger drive controlling unit 892 in some example implementations described above. For example, the flow of one or more processes or implementations may be controlled by logic unit 855 alone or in conjunction with API unit 860.

The foregoing detailed description has set forth various example implementations of the devices and/or processes via the use of block diagrams, schematics, and examples. Insofar as such block diagrams, schematics, and examples contain one or more functions and/or operations, each function and/or operation within such block diagrams, flowcharts, or examples can be implemented, individually and/or collectively, by a wide range of hardware.

While certain example implementations have been described, these example implementations have been presented by way of example only, and are not intended to limit the scope of the protection. Indeed, the novel apparatuses described herein may be embodied in a variety of other forms. Furthermore, various omissions, substitutions and changes in the form of the systems described herein may be made without departing from the spirit of the protection. The accompanying claims and their equivalents are intended to cover such forms or modifications as would fall within the scope and spirit of the protection.

We claim:

1. An auger attachment system for an extendable boom having a first stage, and a second stage, the auger attachment system comprising:

a fixed mounting configured to couple to an auger, the fixed mounting being coupled to the second stage of the extendable boom;

an extendable mounting, configured to couple to the auger, the extendable mounting being slidingly coupled to the first stage of the extendable boom via a sled, and a linear actuator configured to extend and retract the extendable mounting to transfer the auger from a first position coupled to the extendable mounting to a second position coupled to the fixed mounting.

2. The auger attachment system of claim 1, wherein the fixed mounting comprises an auger support arm having an auger support groove configured to receive a support protrusion extending from an attaching bracket of the auger.

3. The auger attachment system of claim 2, wherein the fixed mounting further comprises a lateral support plate positioned adjacent the auger support arm.

4. The auger attachment system of claim 3, wherein the lateral support plate comprises an auger support hole configured to align with a support hole of the attaching bracket of the auger; and wherein the auger attachment system further comprises a holding pin configured to be inserted through the auger support hole and the support hole of the attaching bracket.

5. The auger attachment system of claim 4, wherein the extendable mounting comprises a mounting bracket having a protrusion extending laterally from the extendable mounting, the protrusion configured to engage a groove formed in an attaching bracket of the auger.

6. The auger attachment system of claim 5, wherein the extendable mounting further comprises a pin hole extending through the mounting bracket and configured to align with a support pin hole formed through the attaching bracket of the auger; and wherein the auger attachment system further comprises a retaining pin configured to be inserted through the pin hole of the mounting bracket and the support pin hole of the attaching bracket.

7. The auger attachment system of claim 6, further comprising:

one or more sensors configured to detect a position of the auger relative to the sled, detect a position of the auger relative to a stowage position in which the auger is fully retracted on the extendable mounting, and detect the position of the linear actuator; and an electric control system for the extendable boom and an auger drive, the electric control system configured to lock extension of the extendable boom and operation of the auger drive based on a combination of the one or more sensors and information associated with a crane configuration.

8. The auger attachment system of claim 1, wherein the first stage of the extendable boom comprises a stationary butt stage of the extendable boom; and wherein the second stage of the extendable boom is movable relative to the butt stage.

9. An auger system for an extendable boom having a first stage, and a second stage movable in relation to the first stage, the auger system comprising:

a hydraulic auger; and an auger attachment system comprising:

a fixed mounting configured to couple to the auger, the fixed mounting being coupled to the second stage of the extendable boom;

an extendable mounting, configured to couple to the auger, the extendable mounting being slidingly coupled to the first stage of the extendable boom via a sled, and a linear actuator configured to extend and retract the extendable mounting to transfer the auger from a stowage position coupled to the extendable mounting to a movable position coupled to the fixed mounting on the second stage.

10. The auger system of claim 9, wherein the fixed mounting comprises an auger support arm having an auger support groove configured to receive a support protrusion extending from an attaching bracket of the auger.

11. The auger system of claim 10, wherein the fixed mounting further comprises a lateral support plate positioned adjacent the auger support arm.

12. The auger system of claim 11, wherein the lateral support plate comprises an auger support hole configured to align with a support hole of the attaching bracket of the auger; and wherein the auger attachment system further comprises a holding pin configured to be inserted through the auger support hole and the support hole of the attaching bracket.

13. The auger system of claim 12, wherein the extendable mounting comprises a mounting bracket having a protrusion extending laterally from the extendable mounting, the protrusion configured to engage a groove formed in an attaching bracket of the auger.

14. The auger system of claim 13, wherein the extendable mounting further comprises a pin hole extending through the mounting bracket and configured to align with a support pin hole formed through the attaching bracket of the auger; and wherein the auger attachment system further comprises a retaining pin configured to be inserted through the pin hole of the mounting bracket and the support pin hole of the attaching bracket.

15. The auger system of claim 14, further comprising:

one or more sensors configured to detect at least one of a position of the auger relative to the sled, a position of the auger relative to the stowage position, and the position of the linear actuator; and an electric control system for the extendable boom and an auger drive, the electric control system configured to lock extension of the extendable boom and operation of the auger drive based on a combination of the one or more sensors and information associated with a crane configuration.

16. A boom machine comprising:

an extendable boom comprising:

a first stage; and a second stage;

a hydraulic auger; and an auger attachment system comprising:

a fixed mounting configured to couple to the auger, the fixed mounting being coupled to the second stage of the extendable boom, the second stage being extendable from the first stage;

an extendable mounting, configured to couple to the auger, the extendable mounting being slidingly coupled to the first stage of the extendable boom via a sled, and a linear actuator configured to extend and retract the extendable mounting to transfer the auger from the extendable mounting on the first stage to the fixed mounting on the second stage.

17. The boom machine of claim 16, wherein the fixed mounting comprises an auger support arm having an auger support groove configured to receive a support protrusion extending from an attaching bracket of the auger.

18. The boom machine of claim 17, wherein the fixed mounting further comprises a lateral support plate positioned adjacent the auger support arm.

19. The boom machine of claim 18, wherein the lateral support plate comprises an auger support hole configured to align with a support hole of the attaching bracket of the auger; and wherein the auger attachment system further comprises a holding pin configured to be inserted through the auger support hole and the support hole of the attaching bracket.

20. The boom machine of claim 19, further comprising:

one or more sensors configured to detect a position of the auger relative to the sled, detect a position of the auger relative to a fully retracted position on the extendable mounting, and detect the position of the linear actuator; and an electric control system for the extendable boom and an auger drive, the electric control system configured to lock extension of the extendable boom and operation of the auger drive based on a combination of the one or more sensors and information associated with a boom machine configuration.

* * * * *